US007029424B2

(12) United States Patent
Chen

(10) Patent No.: US 7,029,424 B2
(45) Date of Patent: Apr. 18, 2006

(54) MODULATED TRANSMISSION ASSEMBLY FOR AN EXERCISE BICYCLE

(76) Inventor: Chih-Liang Chen, No. 10, Lane 1431, Kuanghsing Rd., Pateh City, Taoyuan Hsien (TW)

( * ) Notice: Subject to any disclaimer, the term of this patent is extended or adjusted under 35 U.S.C. 154(b) by 146 days.

(21) Appl. No.: 10/839,297

(22) Filed: May 6, 2004

(65) Prior Publication Data

US 2005/0250623 A1 Nov. 10, 2005

(51) Int. Cl.
*A63B 22/06* (2006.01)

(52) U.S. Cl. ..... 482/63

(58) Field of Classification Search ..... 482/51, 482/52, 56, 57, 62–65
See application file for complete search history.

(56) References Cited

U.S. PATENT DOCUMENTS 5,094,447 A * 3/1992 Wang ..... 482/63
5,310,392 A * 5/1994 Lo ..... 482/63
5,466,203 A * 11/1995 Chen ..... 482/63
5,685,805 A * 11/1997 Peritz ..... 482/62
6,821,236 B1 * 11/2004 Liang ..... 482/138
2002/0193207 A1 * 12/2002 Wang et al. ..... 482/63
2005/0020410 A1 * 1/2005 Chang ..... 482/63

* cited by examiner

*Primary Examiner*—Jerome Donnelly
*Assistant Examiner*—Tam Nguyen
(74) *Attorney, Agent, or Firm*—Hershkovitz & Associates; Abe Hershkovitz

(57) ABSTRACT

A modular transmission assembly includes a housing, a drive wheel rotatably mounted the hollow housing, an idler wheel rotatably mounted in the hollow housing and driven by the drive wheel via a belt, a tension rod pivotally connected to the hollow housing and having a distal end abutted to the belt and a resistance device adjustably mounted on the hollow housing to provide different resistances to the idler wheel such that when the drive wheel is rotated, a force to drive the drive wheel to rotate is dependent to the resistance applied to the idler wheel.

5 Claims, 5 Drawing Sheets

MODULATED TRANSMISSION ASSEMBLY FOR AN EXERCISE BICYCLE

BACKGROUND OF THE INVENTION

1. Field of the Invention

The present invention relates to a modular transmission assembly, and more particularly to a modular transmission assembly for an exercise bicycle, with which the user is able to readily have access to all the components such that maintenance is easy.

2. Description of Related Art

Normally, an exercise bicycle is equipped with a transmission assembly fully enclosed inside a casing so that the overall appearance of the exercise bicycle is smooth and appealing. Although the appearance of the exercise bicycle is of particular concern for promoting the market consumption, there is one major drawback for users having this compact exercise bicycle. Because the transmission assembly within the exercise bicycle is compact and fully enclosed inside the casing, the user will have to remove the casing first to proceed to maintenance. Sometimes, the maintenance work is not able to be performed in that the transmission assembly of the exercise bicycle is still further concealed in a housing. Therefore, the user will have to go through a series of dismantling operations until the specific part is exposed to enable maintenance or repair.

To overcome the shortcomings, the present invention provides an improved modular transmission assembly to mitigate the aforementioned problems.

SUMMARY OF THE INVENTION

The primary objective of the present invention is to provide an improved modular transmission assembly having a housing, a drive wheel rotatably connected to the housing and having a major portion thereof exposed out of the housing and an idler wheel rotatably connected to the housing and opposite to the drive wheel, wherein a major portion of the idler wheel is exposed out of the housing. Therefore, the user has an easy access to both the drive wheel and the idler wheel.

Another objective of the present invention is to provide a resistance device adjustably mounted on a side of the housing to apply a force to the idler wheel so as to slow down the rotation of the idler wheel.

Other objects, advantages and novel features of the invention will become more apparent from the following detailed description when taken in conjunction with the accompanying drawings.

DETAILED DESCRIPTION OF THE PREFERRED EMBODIMENT

Figure 1:
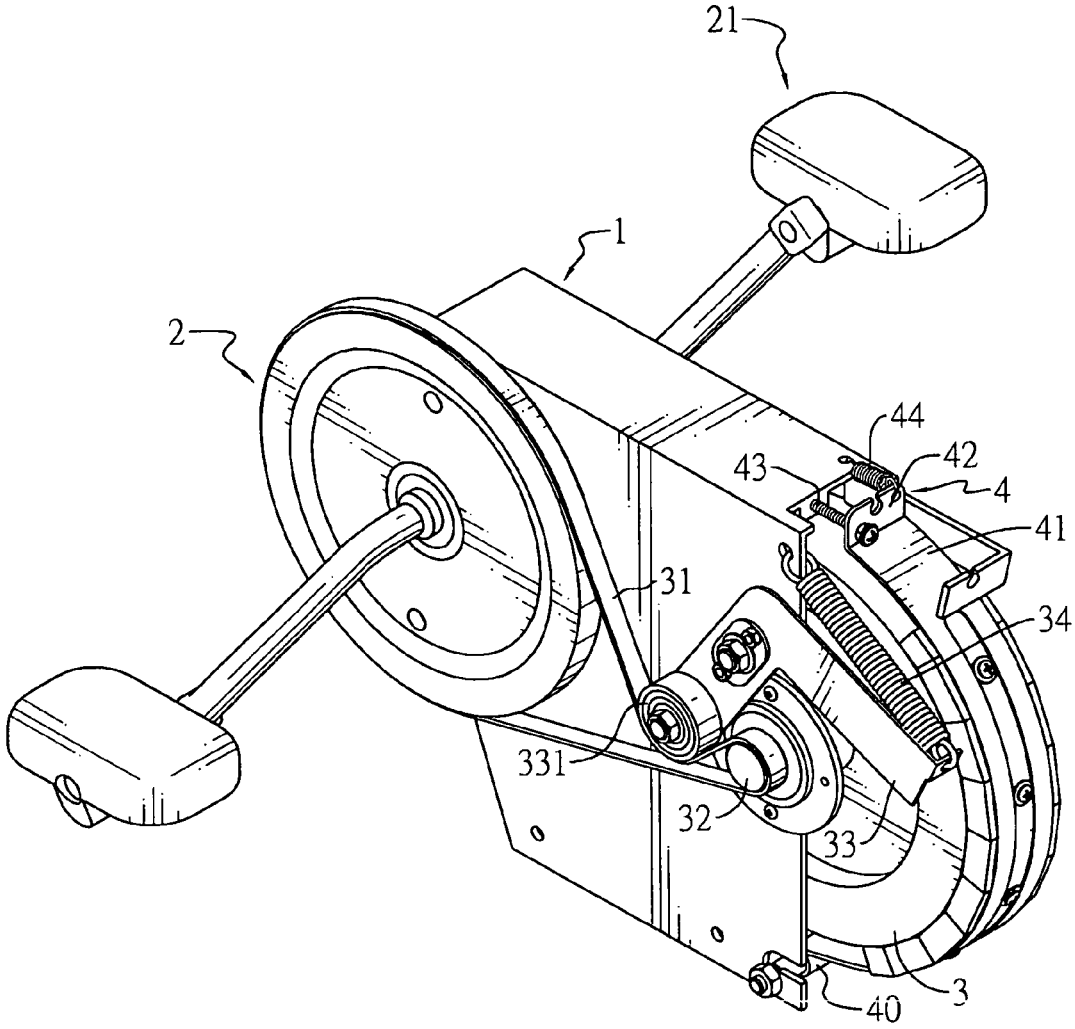
FIG. 1 is a perspective view showing the transmission assembly of the present invention.

With reference to FIG. 1, the modular transmission assembly in accordance with the present invention has a housing (1), a drive wheel (2), an idler wheel (3) and a resistance device (4).

The housing (1) is hollow and has two opposite open ends. The drive wheel (2) is rotatably mounted to one outer side of the housing (1) and has two peddles (21) oppositely connected to the drive wheel (2). The idler wheel (3) is rotatably mounted in the housing (1) and opposite to the drive wheel (2). A portion of the idler wheel (3) is exposed outside the housing (1) and driven by the drive wheel (2) via a belt (31) which is mounted around the drive wheel (2) and a shaft (32) extending from a side of the idler wheel (3) so that when the two peddles (21) are peddled, the rotation of the drive wheel (2) is able to drive the idler wheel (3) to rotate accordingly.

In order to maintain the tension on the belt (31), a tension rod (33) is pivotally mounted on the same side of the housing (1) as the drive wheel (2) and has a first end provided with a bearing (331) in engagement with a portion of the belt (31) and a second end in engagement with a first distal end of a spring (34) a second distal end of which is securely connected to a side face of the housing (1) so that due to the resilience of the spring (34), the first distal end of the tension rod (33) is continuously forced to abut the belt (31) and thus the tension on the belt (31) is maintained.

Furthermore, the resistance device (4) is provided on one open end of the housing (1) and has an arcuate plate (41) having a curvature substantially the same as the curvature of the idler wheel (3). The arcuate plate (41) has a first end (40) securely connected to the housing (1) and a second end provided with a wall (42) extending from the arcuate plate (41). A threaded bolt (43) threadingly extends through the wall (42) to abut a side face of the housing (1). A second spring (44) is securely sandwiched between the side face of the housing (1) and the wall (42) to push the wall (42) away from the side face of the housing (1).

Figure 2:
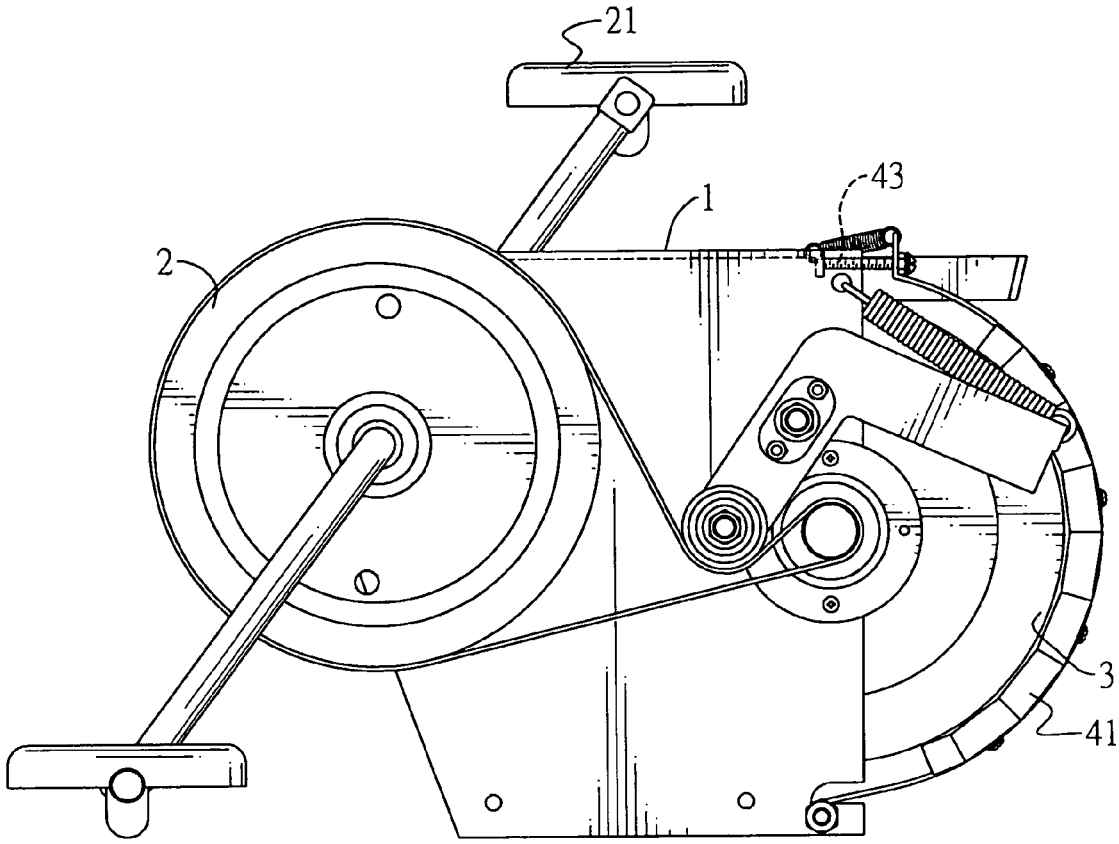
FIG. 2 is a side plan view showing the transmission assembly in FIG. 1.
Figure 3:
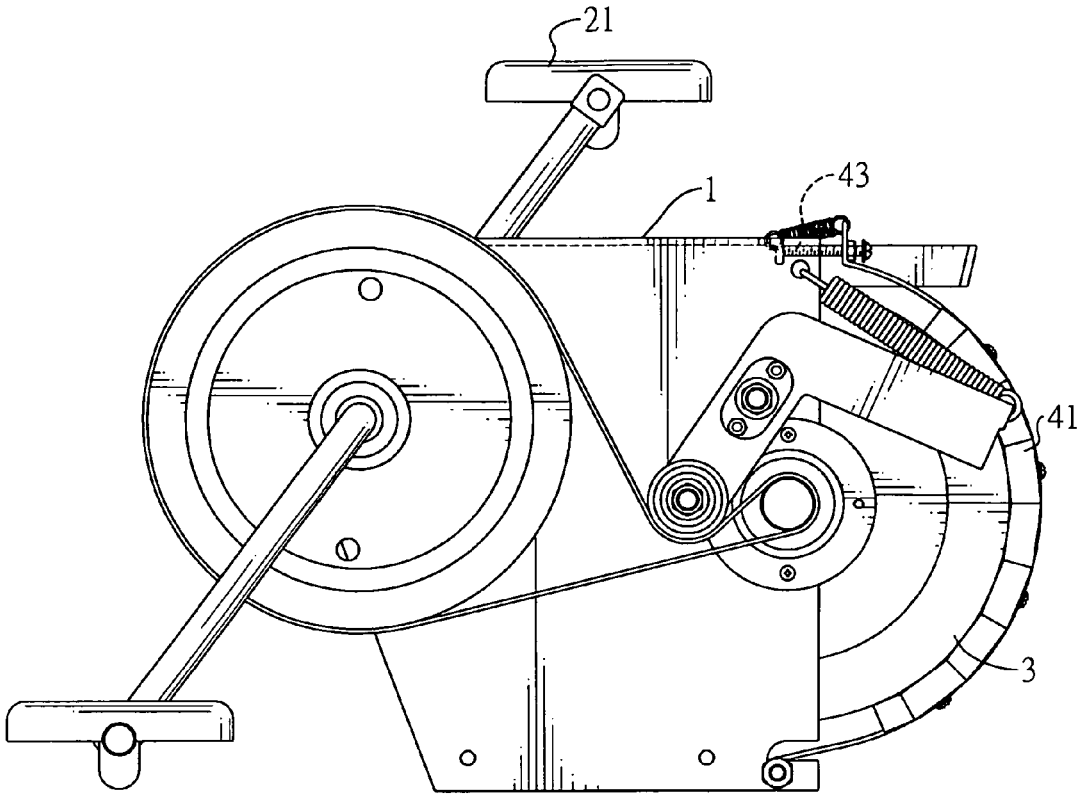
FIG. 3 is a schematic side plan view showing the adjustment of the resistance device.

With reference to FIGS. 2 and 3, it is noted that when the user of the exercise bicycle feels that the resistance on the idler wheel (3) is insufficient or the user wants to increase the strength required for exercise, the user is able to rotate the threaded bolt (43) to decrease the distance between the arcuate plate (41) and the idler wheel (3). Because the distance between the arcuate plate (41) and the idler wheel (3) is reduced, the impedance to the idler wheel (3) is increased and thus the user will have to apply a greater force to turn the peddles (21). On the contrary, if the user feels the resistance to the idler wheel (3) is too strong to overcome while peddling as a consequence of tight engagement between the arcuate plate (41) and the idler wheel (3), the user is able to rotate the threaded bolt (43) to pull the arcuate plate (41) away from the side face of the housing (1) such that with the distance increase between the arcuate plate (41) and the idler wheel (3), the user is able to easily turn the peddles (21).

Figure 4:
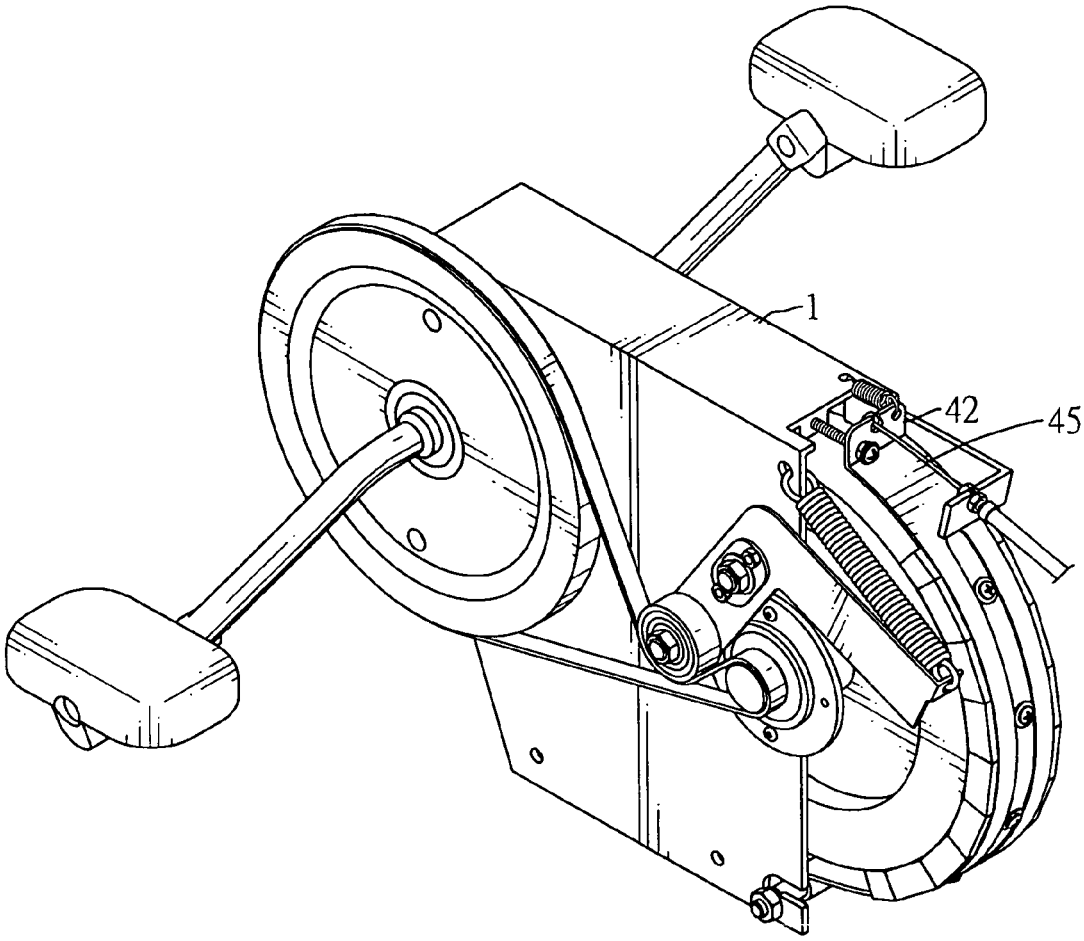
FIG. 4 is a perspective view showing another embodiment of the transmission assembly of the present invention.

With reference to FIG. 4, it is noted that the resistance device (4) may also include a cable (45) having a first end securely connected to the wall (42) and a second end extending out for pulling by the user. That is, the user is able to change the resistance to the idler wheel (3) at any time by simply pulling the cable (45). Because the manner of pulling the cable is conventional in the art, detailed description thereof is thus omitted.

Figure 5:
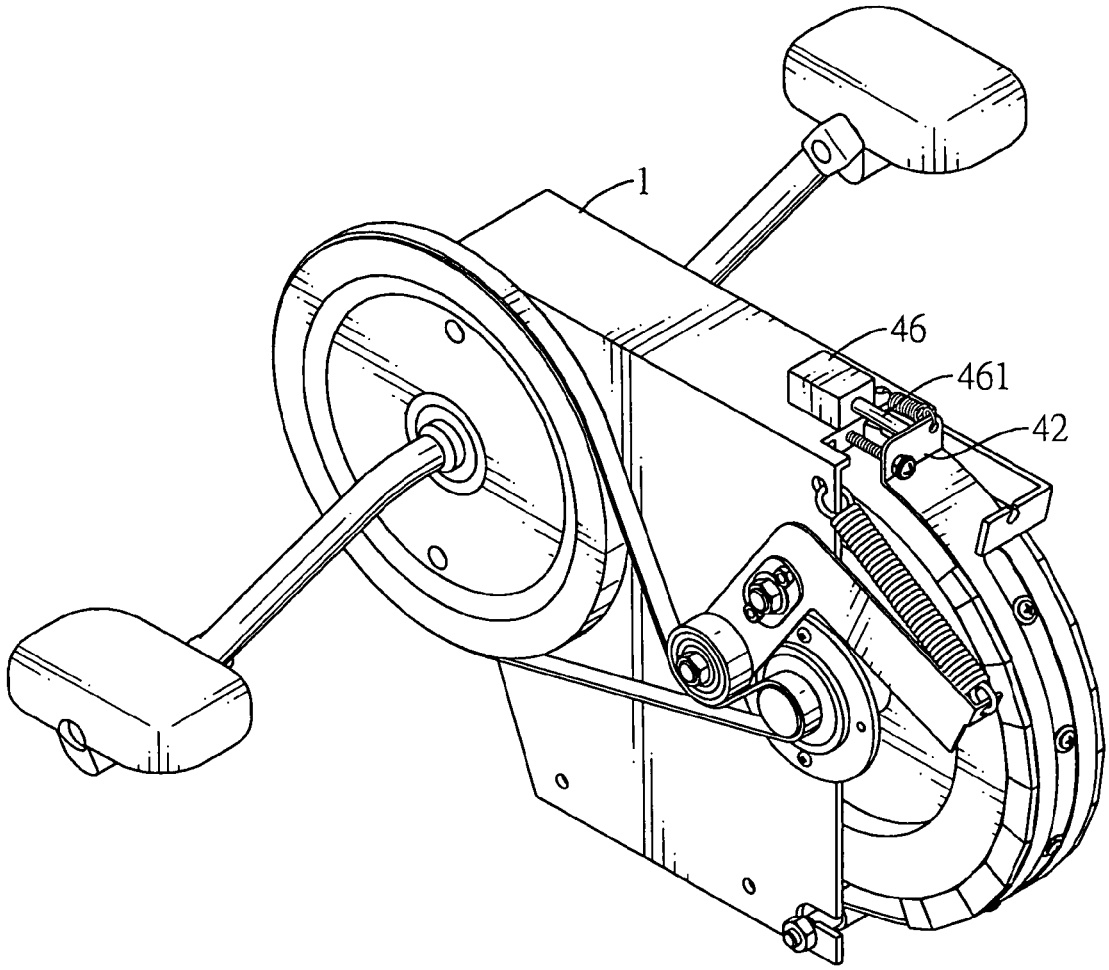
FIG. 5 is a perspective view showing still another embodiment of the transmission assembly of the present invention.

With reference to FIG. 5, it is noted that the resistance device (4) may also include a step motor (46) mounted on the housing (1) and having a motor shaft (461) abutted to the wall (42). That is, the user is able to change the resistance to the idler wheel (3) at any time by simply activating the step motor (46) to allow the motor shaft (461) to extend or retract to change the distance between the arcuate plate (41) and the idler wheel (3). Because the manner of actuation of the step motor (46) is conventional in the art, detailed description thereof is thus omitted.

From the aforementioned description, it is noted that because the drive wheel (2) and the idler wheel (3) are both exposed to the surroundings, the user has easy access to the drive wheel (2) and the idler wheel (3) when either or both have malfunctioned. Furthermore, the user is able to easily adjust the resistance to the idler wheel (3) as required.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exercise bicycle having a modular transmission assembly, the modular transmission assembly comprising:

a hollow housing having two open ends;

a drive wheel connected to an exercise input structure, said drive wheel being rotatably mounted on one external side of the hollow housing;

an idler wheel rotatably mounted in the hollow housing and having a large portion thereof protruding out of the hollow housing;

a belt mounted around the drive wheel and a shaft extending out from the idler wheel to allow rotation of the drive wheel to drive the idler wheel to rotate accordingly;

a tension rod pivotally connected to the hollow housing on the external side the same as that to which the drive wheel is fitted and having a first end abutted to a portion of the belt and a second end securely connected to a first end of a first spring, a second end of which is securely connected to a side face of the hollow housing, such that the first end of the tension rod is maintained in abutment with the belt; and a resistance device adjustably mounted on the hollow housing to provide different resistances to the idler wheel such that when the drive wheel is rotated, a force to drive the drive wheel to rotate is dependent on the resistance applied to the idler wheel, wherein the first end of the tension rod is provided with a bearing to abut the portion of the belt, wherein the resistance device comprises:

an arcuate plate having a curvature substantially the same as that of the idler wheel, a first end securely connected to a side face of the hollow housing and a second end formed with a wall; and a threaded bolt threadingly extending through the wall to abut a side face of the hollow housing such that a distance between the arcuate plate and the idler wheel is adjustable.

2. The modular transmission assembly as claimed in claim 1, wherein the resistance device further has a second spring having a first end securely connected to a side face of the hollow housing and a second end securely connected to the wall to pull the arcuate plate toward the idler wheel.

3. The modular transmission assembly as claimed in claim 1 further comprising a cable having a first end securely connected to the wall and a second end extending out for gripping by a user such that the distance between the arcuate plate and the idler wheel is able to be adjusted.

4. The modular transmission assembly as claimed in claim 2 further comprising a cable having a first end securely connected to the wall and a second end extending Out for gripping by a user such that the distance between the arcuate plate and the idler wheel is able to be adjusted.

5. The modular transmission assembly as claimed in claim 2 further comprising a step motor mounted on the housing and having a motor shaft extending out to abut the wall such that the distance between the arcuate plate and the idler wheel is able to be changed by activation of the step motor.

* * * * *